United States Patent [19]

Koto

[11] Patent Number: 4,806,894

[45] Date of Patent: Feb. 21, 1989

[54] APPARATUS FOR CANCELLING LEAKAGE MAGNETIC FIELD

[75] Inventor: Shingo Koto, Nagasaki, Japan

[73] Assignee: Mitsubishi Denki Kabushiki Kaisha, Tokyo, Japan

[21] Appl. No.: 127,217

[22] Filed: Dec. 1, 1987

[30] Foreign Application Priority Data

Dec. 9, 1986 [JP] Japan ..... 61-291550

[51] Int. Cl.[4] ..... H01F 5/00

[52] U.S. Cl. ..... 335/214; 335/304; 361/146

[58] Field of Search ..... 335/211, 214, 301, 304; 361/146

[56] References Cited

U.S. PATENT DOCUMENTS

| | | | |
|---|---|---|---|
| 2,217,409 | 10/1940 | Hepp | 335/214 |
| 2,234,038 | 3/1941 | Bedford et al. | 335/214 |
| 2,748,305 | 5/1956 | Davies | 335/214 |
| 3,824,515 | 7/1974 | Holman | 335/214 X |
| 4,152,745 | 5/1979 | Eul | 335/214 X |

*Primary Examiner*—George Harris

*Attorney, Agent, or Firm*—Wolf, Greenfield & Sacks

[57] ABSTRACT

A leakage magnetic field cancelling apparatus comprises a magnetic field generating apparatus and a cancelling coil arranged around the magnetic field generating apparatus. By allowing a direct current to flow through the coil, a magnetic field is generated therefrom. The leakage magnetic field generated from the magnetic field generating apparatus is cancelled or controlled by the magnetic field generated from the coil. Thus, the cancelling apparatus can be realized by a cheap and light coil made of a copper wire or the like.

1 Claim, 3 Drawing Sheets

APPARATUS FOR CANCELLING LEAKAGE MAGNETIC FIELD

FIELD OF THE INVENTION

The present invention relates to a leakage magnetic field cancelling apparatus for generating a magnetic field to change the leakage magnetic field of a magnetic field generating apparatus.

DESCRIPTION OF THE RELATED BACKGROUND ART

A deflection yoke to deflect or accelerate an electron beam in, e.g.; a display monitor device and a flyback transformer are known as magnetic field generating apparatus. A leakage magnetic field generated from such a magnetic field generating apparatus needs to be cancelled in order to avoid adverse influences on the other parts and apparatus.

FIG. 1 is a side elevational view showing a conventional leakage magnetic field cancelling apparatus in which a molded portion is removed for simplicity of the drawing. In the diagram, reference numeral 1 denotes a flyback transformer as a magnetic field generating apparatus; 2 is a coil of the flyback transformer 1; 3 a bobbin of the transformer 1; and 4 a leakage magnetic field which is eventually generated from the transformer 1.

A shielding ring 5 is formed of an aluminum or copper plate and generates a magnetic field 6 to cancel the leakage magnetic field 4 from the transformer 1. In general, the ring 5 is formed by an aluminum plate for the purpose of reduction of the weight and is used to shield the electromagnetic waves and electrostatic charges.

The shielding ring 5 is clamped by a clamper or the like (not shown) which is attached to a heat radiating plate or base plate (not shown).

The operation will now be described.

When a current is supplied to the coil 2 of the flyback transformer 1 in order to accelerate an electron beam, the leakage magnetic field 4 is generated so as to pass through the outside of the shielding ring 5. The leakage magnetic field 4 is formed by a part of magnetic line of force generated by the coil 2.

The magnetic field 6 in the opposite direction which is proportional to the leakage magnetic field 4 is generated from the shielding ring 5 by the leakage magnetic field 4 and at the same time, the current flowing through the ring 5 is radiated as the heat by the leakage magnetic field 4.

Since the whole of the magnetic field 6 generated from the ring 5 passes through the outside of the ring 5 in this manner, the influence of the leakage magnetic field 4 can be cancelled by the magnetic field 6. Namely, it is possible to reduce the distortion on the screen of a CRT (cathode ray tube) which is caused by the leakage magnetic field 4 for the deflection yoke of the flyback transformer.

Since the conventional leakage magnetic field cancelling apparatus is constituted in this manner, there is a danger of breakdown of the base plate by the heavy shielding ring 5.

In addition, since the ring 5 is formed by an aluminum or copper plate, the ring 5 is expensive, so that there are problems such that the leakage magnetic field cancelling apparatus becomes expensive and only the leakage magnetic field 4 can be cancelled.

SUMMARY OF THE INVENTION

The present invention is made to solve the abovementioned problems and it is an object of the invention to provide a leakage magnetic field cancelling apparatus which is light and cheap and which can easily control the leakage magnetic field.

In a leakage magnetic field cancelling apparatus according to the invention, a coil to control the leakage magnetic field generated from a magnetic field generating apparatus is arranged around the magnetic field generating apparatus. By allowing a direct current to flow through the coil, a magnetic field which can control the leakage magnetic field generated from the magnetic field generating apparatus is generated.

DETAILED DESCRIPTION OF THE PREFERRED EMBODIMENT

An embodiment of the present invention will be described hereinbelow with reference to the drawings.

Figure 1:
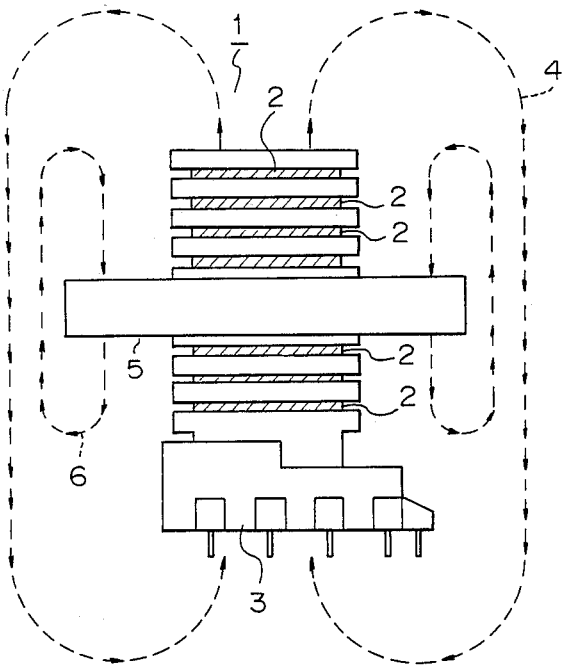
Fig. 1 ( PRIOR ART )
FIG. 1 is a side elevational view showing a conventional leakage magnetic field cancelling apparatus in which a molded portion is removed.
Figure 2:
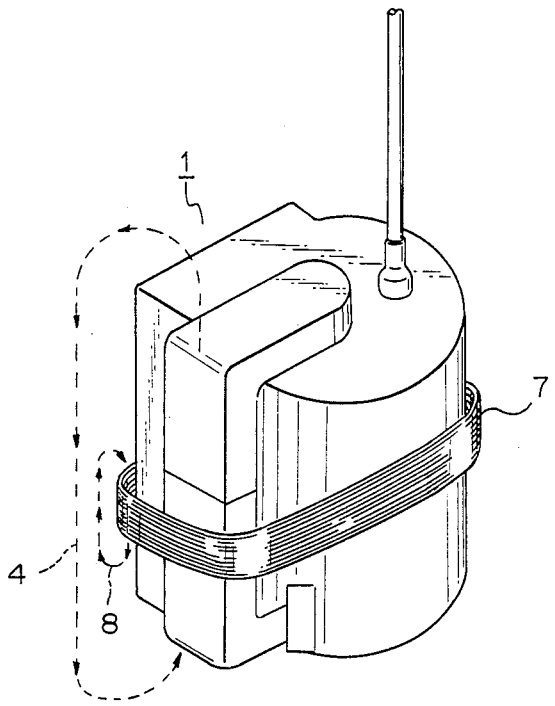
FIG. 2 is an external perspective view showing a leakage magnetic field cancelling apparatus according to an embodiment of the invention.

In FIG. 2, the same parts and components as those shown in FIG. 1 are designated by the same reference numerals. Reference numeral 7 denotes a cancelling coil arranged around the flyback transformer 1. As shown in the diagram, by allowing a direct current to flow through the coil 7, a magnetic field 8 is generated, thereby controlling the leakage magnetic field 4 generated from the transformer 1.

The cancelling coil 7 is clamped by a clamper or the like (not shown) which is attached to a heat radiating plate or base plate (not shown).

Figure 3:
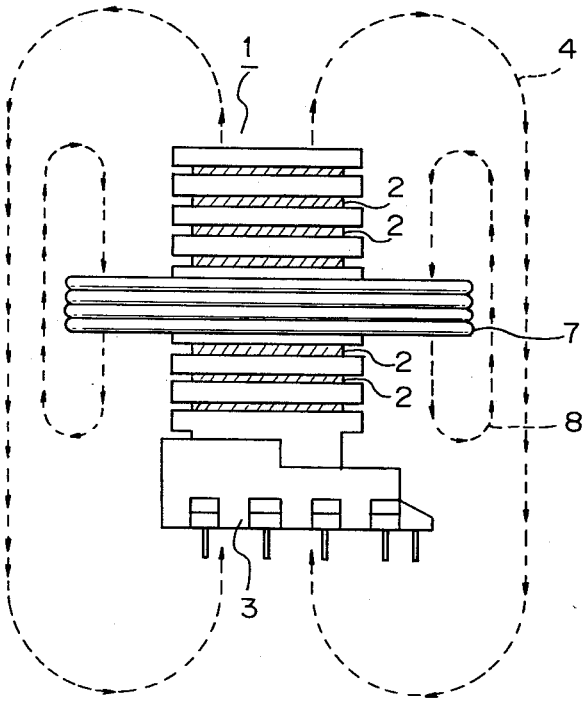
FIG. 3 is a side elevational view showing the leakage magnetic field cancelling apparatus in which a molded portion is removed.

FIG. 3 is a side elevational view similar to FIG. 1, in which a molded portion is likewise removed.

The operation will now be described.

When a current is supplied to the coil 2 of the flyback transformer 1 in order to accelerate an electron beam, the leakage magnetic field 4 passing through the outside of the transformer 1 is generated. In order to cancel or control the leakage magnetic field 4, a direct current is allowed to flow through the coil 7, thereby generating the magnetic field 8. Thus, the leakage magnetic field 4 can be cancelled or controlled by the magnetic field 8.

In the leakage magnetic field cancelling apparatus according to the invention, the magnetic field 8 to cancel or control the leakage magnetic field 4 is generated from the cancelling coil 7 as explained above. Thus, the coil 7 can be cheaply constituted by use of a wire material such as a copper wire or the like and its weight is lighter than that of the conventional shielding ring 5. Therefore, damage of the base plate can be prevented.

By adjusting the number of turns of the cancelling coil 7 or the adjusting the direct current flowing through the coil 7, the leakage magnetic field 4 can be cancelled by the magnetic field 8 generated from the coil 7 and at the same time, the magnitude and direction of the final leakage magnetic field 4 or magnetic field 8 can be also controlled.

Although the case of the flyback transformer 1 has been described in the embodiment, the invention can be also applied to, e.g., switching transformer, common mode choke filter, demodulating coil, PCC transformer, horizontal drive transformer, etc.

On the other hand, although only the magnetic field generating apparatus has been located inside the cancelling coil 7, the peripheral parts of the magnetic field generating apparatus can also be similarly arranged inside the cancelling coil 7.

As described above, according to the invention, the coil to generate the magnetic field to cancel or control the leakage magnetic field generated from the magnetic field generating apparatus is arranged around the magnetic field generating apparatus. Therefore, the coil can be cheaply constituted with a light weight. Thus, the leakage magnetic field cancelling apparatus can be cheaply manufactured and damage of the base plate of the cancelling apparatus can be prevented.

In addition, by adjusting the number of turns of the cancelling coil or by adjusting a direct current flowing therethrough, the leakage magnetic field can be cancelled by the magnetic field generated from the coil and the magnitude and direction of the final magnetic field can be also controlled.

What is claimed is:

1. Flyback transformer apparatus for use with video display monitors comprising a magnetically permeable core;

a primary winding surrounding at least a part of said core, said winding being electrically driven by an alternating current to generate a fluctuating magnetic field having an average D.C. value;

a secondary winding surrounding at least a part of said core, said secondary winding being responsive to said fluctuating magnetic field for developing a voltage for use in said video display monitor;

a leakage cancelling winding surrounding said primary winding, said secondary winding and said core; and means for causing a direct current to flow through said leakage cancelling winding to generate a leakage cancelling magnetic field in a direction opposite to said average D.C. value of said fluctuating magnetic field so that said leakage cancelling magnetic field substantially cancels said average D.C. component of said fluctuating magnetic field.

* * * * *